United States Patent [19]

Knechtel

[11] 3,955,530

[45] May 11, 1976

[54] TRANSFER-FIXING DEVICE

[75] Inventor: Wilhelm Knechtel, Biebertal, Germany

[73] Assignee: Canon Kabushiki Kaisha, Tokyo, Japan

[22] Filed: June 26, 1974

[21] Appl. No.: 483,405

[30] Foreign Application Priority Data

June 28, 1973 Japan ..... 48-73201

[52] U.S. Cl. ..... 118/60; 118/101; 118/637; 427/24

[51] Int. Cl.[2] ..... G03G 15/16; G03G 15/20; G03G 15/22

[58] Field of Search ..... 118/60, 637, 641, 101, 118/258; 432/60, 228; 117/21, 17.5; 96/1.4; 427/24; 355/3 TR

[56] References Cited

UNITED STATES PATENTS

| | | | |
|---|---|---|---|
| 3,128,379 | 4/1964 | Cisek et al. | 118/637 |
| 3,592,642 | 7/1971 | Kaupp | 117/21 |
| 3,666,247 | 5/1972 | Banks | 432/60 |
| 3,698,314 | 10/1972 | Grier | 118/60 |
| 3,751,156 | 8/1973 | Szostak et al. | 118/637 |
| 3,807,997 | 4/1974 | Cade et al. | 118/637 |
| 3,851,964 | 12/1974 | Smith et al. | 96/1.4 |

*Primary Examiner*—Mervin Stein
*Assistant Examiner*—Douglas Salser
*Attorney, Agent, or Firm*—Fitzpatrick, Cella, Harper & Scinto

[57] ABSTRACT

In a transfer-fixing device for transferring a developed image from an image carrier onto a transfer medium, there is provided urge means for urging the transfer medium against the image carrier, and heating means disposed adjacent the urge means for heating the urge means substantially at the same time that the transfer medium is urged against the image carrier.

9 Claims, 4 Drawing Figures

TRANSFER-FIXING DEVICE

BACKGROUND OF THE INVENTION

1. Field of the Invention

This invention relates to an electrophotographic apparatus, and more particularly to a transfer-fixing device in such apparatus.

2. Description of the Prior Art

In order that a developed image on the surface of a photosensitive medium may be transferred onto a transfer medium and fixed thereon, the electrophotographic copying apparatus has heretofore required two process steps, i.e., the step of transferring the developed image from the surface of the photosensitive medium and the step of fixing the transferred image on the transfer medium. The transfer step has been done with the transfer medium brought into contact with the surface of the photosensitive medium by means of a transfer roller or a transfer corona discharger. However, this has lead to various problems in that pieces of the transfer medium or dust tend to stick to and damage the surface of the photosensitive medium; when the surface of the photosensitive medium is cleaned the dust or other foreign materials tend to mix with recovered developer to make such developer unfit for reuse, and invasion of the dust or other foreign materials into the developing device reduces the developing efficiency. The fixing step has been effected either by heating the transfer medium with the developed image thereon by irradiating such transfer medium with an infrared ray lamp or the like during the transport of the transfer medium, or by heating the transfer medium as it is passed on a hot plate. However, these techniques result in a great loss of heat and accordingly a reduced heating effect when heat is applied to the transfer medium for melting-fixing or for dry fixing. Further, according to the prior art, the developed image has been transferred onto the transfer medium and then the transfer medium has been transported to the fixing step, whereas the transfer medium, which is usually flexible, has been subject to vibrations during the course of such transport, which in turn has resulted in disturbance of the transferred image on the transfer medium. All of these problems have been very inconvenient to overcome.

SUMMARY OF THE INVENTION

It is an object of the present invention to overcome the above-noted disadvantages peculiar to the prior art, and to provide a transfer-fixing device which enables good copy images to be formed on transfer mediums without adversely affecting the photosensitive medium.

It is another object of the present invention to provide a highly effective transfer-fixing device which is designed to effect both transfer and fixing at the same time.

It is still another object of the present invention to provide a transfer-fixing device which has suitable arrangements for effecting the transfer and the fixing at the same time.

Generally describing the present invention, when a developed image carried on an image carrier is transferred to a transfer medium, the transfer medium is urged against the image carrier while being heated and fixed.

The term "image carrier" used herein generically refers to a structure hereinafter expressed as a photosensitive medium, intermediate transfer drum, etc. In other words, it means a structure capable of carrying a developed image thereon, and in some cases may be a photosensitive medium including a photoconductive layer, or it may simply be an insulating medium, or a metallic medium having its surface processed. If desired, it may take a further form comprising a combination of these or any other form.

The invention will become more fully apparent from the following detailed description of some specific embodiments thereof taken in conjunction with the accompanying drawings.

DESCRIPTION OF THE PREFERRED EMBODIMENTS

Figure 1:
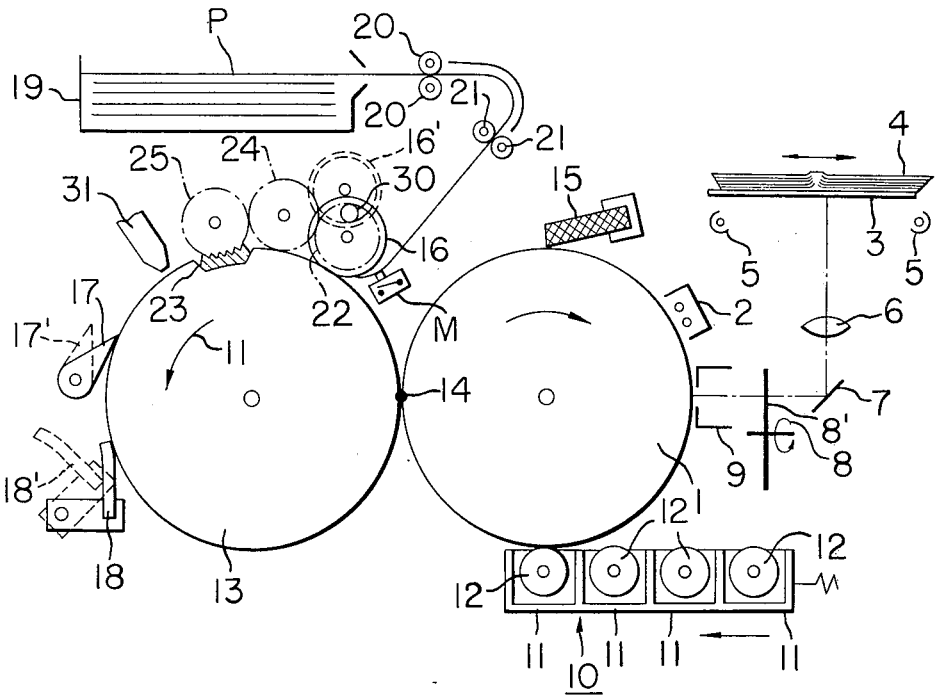
FIG. 1 schematically illustrates the construction of the copying apparatus to which the transfer-fixing device of the present invention is applied.

Referring to FIG. 1, there is shown an embodiment of the transfer-fixing device of the present invention as applied in an electrophotographic color copying apparatus. Reference numeral 1 designates an electrophotographic sensitive drum rotatable in the direction of the arrow thereon and having a photosensitive layer formed of selenium, cadmium sulfide or like material. A uniform overall charge is applied to the surface of such photosensitive drum by a corona charger 2. Subsequently, a colored original 4 on a movable carriage 3 is illuminated by an illuminating light source 5 and the light reflected from the colored original is directed through a fixed projection lens 6 and via a mirror 7 and through filter means 8 and slit 9 to the surface of the photosensitive medium so that such surface is exposed to a first color light extracted from the original image. Thereby, an electrostatic latent image corresponding to the first color component of the colored original is formed on the surface of the photosensitive medium. The filter means comprises color resolving filters 8' corresponding in number to the number of the colors resolved and rotatably mounted on a rotatable member so that a particular one of the color resolving filters may be positioned in the path of the applied image light during each color resolution. Each electrostatic latent image so formed by the application of the image light comes round to a developing station, where it is developed by a developing device 10 having a plurality of developing units 11 to provide a developed color image corresponding to the light images effected by the filters 8'. The developing units 11 of the developing device 10 respectively have predetermined color developers corresponding to the various color resolving filters and are provided with respective developer supply means such as rotatable magnetic rollers 12 or the like which are capable of individually supplying the respective developers to the surface of the latent image.

The developing device is movable in the direction of the arrow therebelow in accordance with the rotational movement of the filter means 8. After the developed image has been formed, the photosensitive drum further rotates in the direction of the arrow to transfer the image onto an intermediate transfer drum 13 which has a diameter equal to that of the photosensitive drum and is rotating at the same speed as the latter. By these means the first color developed image is transferred and retained on the intermediate transfer drum 13. This intermediate transfer drum is rotated in the direction of the arrow thereon at the same speed as the photosensitive drum and makes a line contact at 14 with the photosensitive drum. The photosensitive drum and the intermediate transfer drum are connected together by gearing or the like. The developed image on the photosensitive drum is transferred to the intermediate transfer drum at the line of contact 14. After having completed the transfer, the photosensitive drum is cleaned by a cleaning blade 15 so that it may be used to form a developed image corresponding to a second color resolved from the colored original image. When the second color developed image is formed, this developed image is transferred onto the intermediate transfer drum in superposed relationship with the previously transferred color image, again by the line contact.

Figure 2:
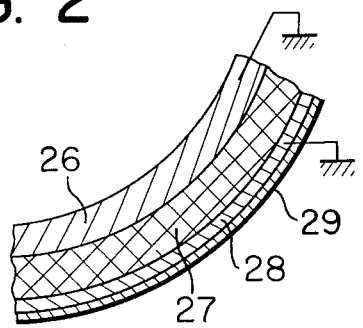
FIG. 2 is a fragmentary detailed view of the intermediate transfer drum in the apparatus of FIG. 1.

The above-described process is repeated as frequently as the number of the colors resolved from a colored original until a multi-colored transfer image identical with the colored original image is finally formed on the intermediate transfer drum. While the superposition-transfer of the resolved color images is repeated, a hot roller 16 for transfer-fixing, a separator pawl 17 for separating a transfer medium from the surface of the intermediate transfer drum, and a cleaning blade 18 for cleaning the surface of the transfer drum are deviated to respective phantom-line positions 16', 17' and 18' so as to be out of contact with the intermediate transfer drum. When the color developed image corresponding to the colored original is formed on the surface of the intermediate transfer drum, a transfer medium such as ordinary paper P is fed from a transfer medium container 19 onto the intermediate transfer drum by feed rollers 20, 21. On the other hand, the hot roller 16 is turned and moved from the phantom-line position 16' to the solid-line position on the surface of the intermediate transfer drum, i.e. the transfer-fixing position, in response to a signal produced from a microswitch M upon passage of the transfer medium P, so that the transfer medium P is passed between the nip of the surfaces of the intermediate transfer drum and the hot roller. The hot roller is designed such that a gear 22 concentric with the hot roller is connected to a gear 23 concentric with the intermediate transfer drum by means of gears 24 and 25 meshing with each other and with the gears 22 and 23, respectively, whereby the hot roller is rotatable at the same speed as the intermediate transfer drum. The hot roller, even in its phantom-line position, is maintained in an operative driving connection with the intermediate transfer drum. As the transfer medium is passed between the hot roller and the intermediate transfer drum, the transfer medium is urged against the transfer drum to receive the image transferred therefrom while the high temperature of the hot roller melts the toner on the transfer medium. The intermediate transfer drum, as shown in FIG. 2, comprises an aluminum cylinder 26 covered with a silicon crepe rubber coating 27, an aluminum foil 28 and a heat-resistant Teflon layer 29 in succession. The crepe rubber layer 27 acts as a heat-insulating layer and thus, the heat energy from the hot-roller 16 is not dissipated during the melting of the toner. Therefore, the heat supply necessary for the hot roller may be very small. In other words, the efficiency of the device is increased.

In this connection, the crepe rubber layer 27 produces the following effect. The hot roller somewhat depresses the surface of the intermediate transfer drum in the contact portion and so, when it urges the transfer medium P against the intermediate transfer drum, it readily deforms the surface of this drum. Therefore, the contact between the drum and the hot roller is not a definite line contact but a surface contact which increases the time during which the hot roller acts on the toner. Also, the hot roller 16 is thin-walled because it must be quickly heated at the starting of the copying machine. The hot roller may comprise an aluminum tube, for example. Disposed within the hot roller is an infrared ray source 30 which remains positionally unchanged even when the hot roller 16 is turned. The developed image, when melted, is absorbed in the transfer medium whereafter the melted toner is cooled and solidified by the air from a cooling blower 31. Where the developed image is a liquid-developed one, image transfer is effected with the hot roller urged against and heating the transfer medium while the liquid component in the developer is evaporated. The cooling air from the blower cools down not only the transfer medium and the transferred image thereon but also the intermediate transfer drum. After such retransfer of the image from the intermediate transfer drum to the transfer medium, and when the fixing and cooling of the re-transferred image has been completed, the transfer medium is separated from the intermediate transfer drum by the separator pawl 17 which has been pivoted from the phantom-line position to the solid-line position. When the pawl 17 strips the transfer medium off the intermediate transfer drum, the Teflon layer acts to prevent the transferred image from adhering to the intermediate transfer drum, thus ensuring that the separation takes place readily. After the image is transferred and fixed to the transfer medium, and after the separation of such transfer medium has been completed, the intermediate transfer drum is cleaned for use in the next copying cycle by the cleaning blade 18 which has been moved from the phantom-line position to the solid-line position.

Although the present invention has particularly been described with respect to an embodiment of the transfer-fixing device, it will be apparent that the present invention is applicable not only to the illustrated color copying apparatus but also to monochromatic copying apparatus for producing black-and-white copies.

Figure 3:
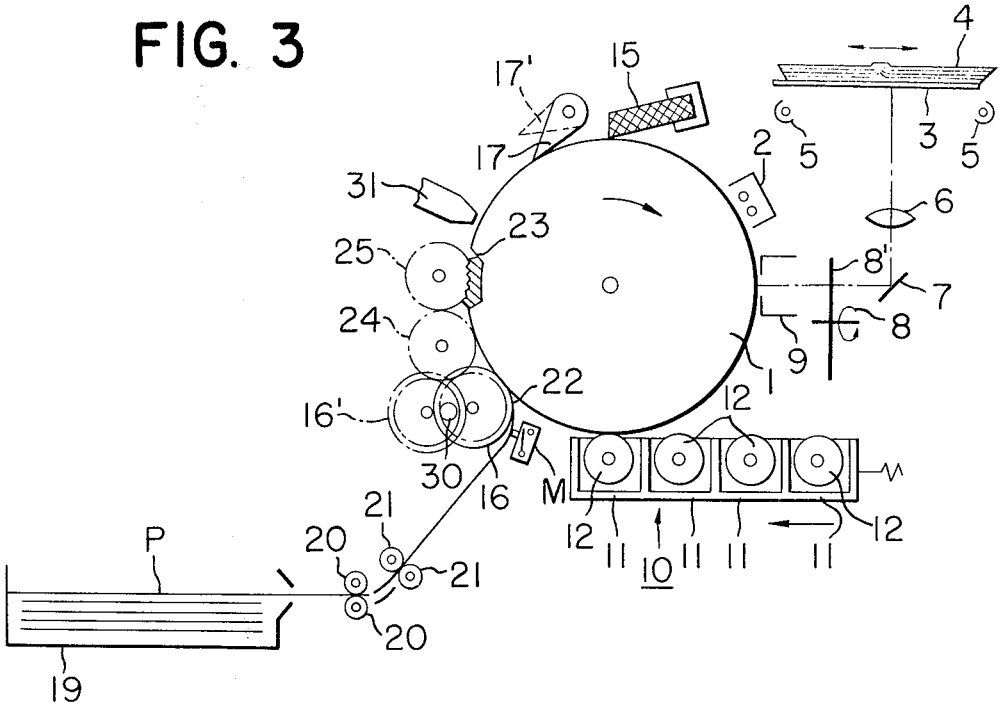
FIG. 3 shows an embodiment of the device which employs no intermediate drum.

The present invention may also take the form as shown in FIG. 3, wherein transfer medium P is directly urged against the photosensitive medium 1. Such embodiment lacks the effect as provided by the use of an intermediate drum, but a good result may be obtained with more effective reuse of the photosensitive medium if, for example, the wavelength of the infrared light from the infrared ray source 30 includes therein a component best suited for the recovery of the photosensitive medium from its fatigue.

Figure 4:
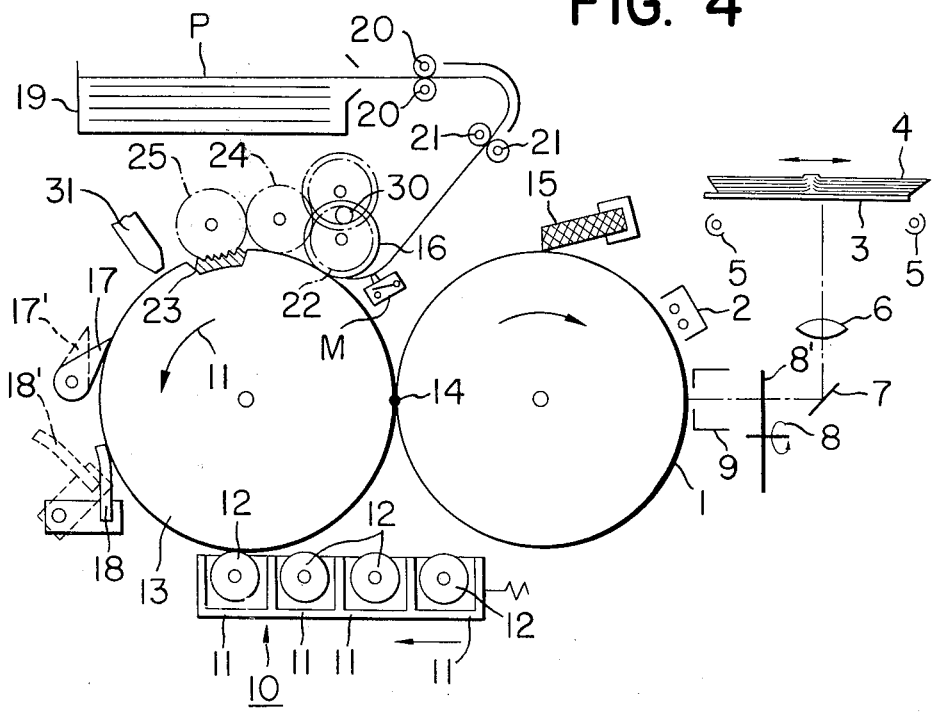
FIG. 4 shows a further embodiment in which a latent image is transferred onto an intermedite transfer drum and then developed thereon.

The present invention may effectively take a further form as shown in FIG. 4, wherein development does not occur on the photosensitive medium but development occurs on the intermediate drum and then transfer occurs therefrom. In this embodiment, the photosensitive drum 1 and the intermediate transfer drum 13 are in direct contact with each other to effect the transfer of the latent image. The photosensitive medium may comprise, for example, a screen-like member having numerous openings therein and, with such screen-like photosensitive medium in contact or non-contact with the intermediate transfer drum, an electrostatic latent image modulated to a latent image formed on the photosensitive medium may be formed on the transfer drum by the use of a corona source or the like (not shown).

In such arrangement, neither the transfer medium nor the developer affects the photosensitive medium in any way and this is highly advantageous for the maintenance of the photosensitive medium.

With the device of the present invention, as has been described above, the image transfer from the image carrier to the transfer medium may take place while heating-fixing of the transferred image is occurring, and thus only a single step is required instead of the two steps required in the prior art. In addition, the device of the present invention eliminates the possibility of the formed image becoming disturbed when being transported in an unfixed condition and this is highly effective to maintain the transferred image in good condition. Further, in the arrangement wherein the transfer medium is urged against a hot roller, the invention will ensure a very high heat efficiency because heat is directly imparted to the transfer medium.

Furthermore, in the arrangement wherein transfer occurs from the photosensitive medium to the intermediate transfer medium and thence to the final transfer medium, the surface of the photosensitive medium is not damaged by pieces of the transfer medium or dust which would otherwise tend to stick to such surface, and a homogeneous intermediate transfer member may be used as the transfer medium next to the photosensitive medium, which ensures the surface of the photosensitive medium to be safe from injuries, thereby increasing the service life of such medium.

I claim:

1. A transfer-fixing device for transferring a developed image onto a transfer medium, said device comprising:

an image carrier having a surface for carrying a developed image, said image carrier having a metallic base, an elastic layer of heat insulating material covering said metallic base and a heat-resistant layer covering said elastic layer and forming said surface;

means for urging the transfer medium against said surface of said image carrier; and means for heating said urging means so that the transfer medium is in a heated condition at the time it is urged against said image carrier.

2. A device according to claim 1, wherein said urging means is pivotally movable away from and toward said surface of said image carrier.

3. A device according to claim 2, wherein said urging means comprises a roller mounted for pivotal movement and having said heating means disposed therewithin.

4. A device according to claim 3, wherein said heating means disposed within said roller is fixedly mounted with respect to pivotal movement of said roller.

5. A device according to claim 1, wherein said image carrier further includes a thin metallic layer disposed between said elastic layer and said heat-resistant layer.

6. A device according to claim 5, wherein said thin metallic layer is a sheet of aluminum foil.

7. A device according to claim 1, wherein said metallic base is an aluminum cylinder.

8. A device according to claim 1, wherein said elastic layer is a layer of silicon crepe rubber.

9. A device according to claim 1, wherein said heat-resistant layer is a teflon layer.

* * * * *